US012521596B2

(12) United States Patent
Gilbert

(10) Patent No.: US 12,521,596 B2
(45) Date of Patent: Jan. 13, 2026

(54) APPARATUS FOR RESISTANCE TRAINING

(71) Applicant: Laura Louise Gilbert, Saxmundham (GB)

(72) Inventor: Laura Louise Gilbert, Saxmundham (GB)

( * ) Notice: Subject to any disclaimer, the term of this patent is extended or adjusted under 35 U.S.C. 154(b) by 282 days.

(21) Appl. No.: 18/559,727

(22) PCT Filed: May 10, 2022

(86) PCT No.: PCT/GB2022/051179
§ 371 (c)(1),
(2) Date: Nov. 8, 2023

(87) PCT Pub. No.: WO2022/238692
PCT Pub. Date: Nov. 17, 2022

(65) Prior Publication Data

US 2024/0374950 A1 Nov. 14, 2024

(30) Foreign Application Priority Data

May 10, 2021 (GB) ..... 2106626

(51) Int. Cl.
*A63B 21/06* (2006.01)
*A63B 21/00* (2006.01)
*A63B 21/062* (2006.01)

(52) U.S. Cl.
CPC ..... *A63B 21/0617* (2015.10); *A63B 21/0628* (2015.10); *A63B 21/154* (2013.01); *A63B 2225/09* (2013.01)

(58) Field of Classification Search
CPC ..... A63B 21/0616; A63B 21/0617; A63B 21/0628; A63B 21/154; A63B 21/155; A63B 2225/09; A63B 2225/093
See application file for complete search history.

(56) References Cited

U.S. PATENT DOCUMENTS 4,600,189 A * 7/1986 Olschansky ..... A63B 21/4047 482/142
5,356,360 A * 10/1994 Johns ..... A63B 21/0628 482/99
5,447,480 A 9/1995 Fulks
5,554,085 A 9/1996 Dalebout
10,265,581 B2 * 4/2019 O'Connor ..... A63B 21/4047
(Continued)

*Primary Examiner* — Zachary T Moore
(74) *Attorney, Agent, or Firm* — Kolitch Romano Dascenzo Gates LLC

(57) ABSTRACT

An apparatus for resistance training comprising a frame supporting: a rotational pivot for providing rotation in a vertical plane; a horizontal reaction arm adapted to be moved by a human user; and an actuation arm rotatably mounted on the rotational pivot and rotationally mounted on the horizontal reaction arm; such that a force on the horizontal reaction arm causes the reaction arm to move about the rotational pivot whilst remaining horizontal. The frame further comprises a resistance means arranged to apply a user-selected resistive force that must be overcome to induce movement of the horizontal reaction arm from a rest position. The actuation arm has a length that is adjustable by the human user. The rotational pivot is vertically moveable within the frame. The horizontal reaction arm is capable of being moved in both a clockwise or anti-clockwise sense about the rotational pivot.

14 Claims, 4 Drawing Sheets

(56) References Cited

U.S. PATENT DOCUMENTS

| | | | | |
|---|---|---|---|---|
| 11,806,578 | B2 * | 11/2023 | Rose | A63B 21/0628 |
| 2007/0161472 | A1 * | 7/2007 | Drechsler | A63B 21/4045<br>482/99 |
| 2011/0218083 | A1 | 9/2011 | Staff | |
| 2012/0277069 | A1 * | 11/2012 | Hockridge | A63B 21/159<br>482/139 |
| 2016/0279459 | A1 * | 9/2016 | Walker | A63B 21/4047 |
| 2017/0319905 | A1 * | 11/2017 | O'Connor | A63B 21/00181 |
| 2020/0179750 | A1 * | 6/2020 | Carter | A63B 23/0405 |

* cited by examiner

APPARATUS FOR RESISTANCE TRAINING

TECHNICAL FIELD

The present invention relates to an apparatus for resistance training for use by a human user, the apparatus comprising a frame supporting: a rotational pivot for providing rotation in a vertical plane; and a horizontal reaction arm adapted to be moved by a body part of the human user; and an actuation arm, the actuation arm being rotatably mounted on the rotational pivot and rotationally mounted on the horizontal reaction arm; such that application of force on the horizontal reaction arm causes the reaction arm to move about the rotational pivot whilst remaining horizontal; the frame further comprising a resistance means arranged to apply a user-selected resistive force that must be overcome to induce movement of the horizontal reaction arm from a rest position, wherein the actuation arm has a length that is adjustable by the human user, wherein the rotational pivot is vertically moveable within the frame, and wherein the horizontal reaction arm is capable of being moved in both a clockwise or anti-clockwise sense about the rotational pivot.

Background and Prior Art

Apparatus that allows a human user to carry out resistance training in a controlled and safe manner, by acting against a resistive force by pushing or pulling on a reaction arm mounted in a frame, sometimes called machines, are well-known.

In general, such machines are constructed such that they are to exercise a specific muscle or group of muscles. The machine is adapted so that the resistance training can be carried out in a controlled and safe manner. However since each machine is dedicated to a specific type of movement, a plurality of machines are required in order to be able to provide the ability to offer a full range of resistance training options.

US 2011/0218083, US 2012/0277069, US2020/0179750, U.S. Pat. No. 4,600,189 and US 2007/0161472 A1 disclose resistance training apparatus' to be used by a human user, comprising a frame and a horizontal reaction arm rotatably mounted on a rotatable pivot.

Machines also exist where a horizontal reaction arm can move through a variety of arcs about a rotatable pivot by adjusting the length of a connecting actuation arm.

Continuing improvements in this area would be highly desirable.

BRIEF DESCRIPTION OF THE INVENTION

The present invention relates to an apparatus for resistance training for use by a human user, the apparatus comprising a frame supporting: a rotational pivot for providing rotation in a vertical plane; and a horizontal reaction arm adapted to be moved by a body part of the human user; and an actuation arm, the actuation arm being rotatably mounted on the rotational pivot and rotationally mounted on the horizontal reaction arm; such that application of force on the horizontal reaction arm causes the reaction arm to move about the rotational pivot whilst remaining horizontal; the frame further comprising a resistance means arranged to apply a user-selected resistive force that must be overcome to induce movement of the horizontal reaction arm from a rest position, wherein the actuation arm has a length that is adjustable by the human user, wherein the rotational pivot is vertically moveable within the frame, and wherein the horizontal reaction arm is capable of being moved in both a clockwise or anti-clockwise sense about the rotational pivot Due to the number of adjustable components, the apparatus can be adjusted to perform a wide variety of resistance training movements in a single machine, thus providing an extremely versatile and space-efficient means of carrying out resistance training on a wide variety of muscle groups.

Preferably, the actuation arm is perpendicular to the horizontal reaction arm.

In general, movement of the horizontal reaction arm causes it to rotate about the rotational pivot in a circular manner. This is most conveniently achieved wherein the horizontal reaction arm is connected to the rotational pivot directly by the actuation arm, when the actuation arm maintains a constant distance between the rotational pivot and the horizontal reaction arm. However, additional means of connecting the horizontal reaction arm to the rotational pivot may be envisaged such as by the use of cams or additional actuation arms.

Preferably, movement in each rotational sense has the same resistive force response. This enables a wider variety of exercises to be carried out, and in particular enables both pulling and pushing exercises to be carried out, e.g. from a seated position.

The resistance means may take a variety of forms, e.g. a conventional weight stack attached by cables to the horizontal reaction arm. Alternatively a counter-weight system could be provided, such that movement of the horizontal reaction arm causes resistance due to the leverage of the counterweight. Another preferred means of applying resistive force is by the use of motors, which can be more compact, and can be more easily controlled, e.g. by an input screen or keyboard.

In a preferred embodiment, the radius of curvature of the movement of the horizontal reaction arm is adjustable from less than 20 cm to greater than 30 cm, preferably from less than 10 cm to greater than 30 cm, preferably from less than 5 cm to greater than 40 cm, more preferably from less than 5 cm to greater than 50 cm. A practical range from less than 20 cm to greater than 60 cm has been found to be useful. Providing this wide range of different radii of curvature allows for a wide variety of exercises to be carried out. Such adjustment in the length of the actuation arm may be facilitated in a number of different ways, e.g. by means of a pin-and-hole adjustment mechanism. In a preferred arrangement the actuation arm is arranged to slideably engage with the rotational pivot, e.g. through a sleeve such as a box section, wherein the sleeve is rotatably connected to the rotational pivot. This enables a wide range of possible lengths of the actuation arm and thus the radii of curvature of the horizontal reaction arm.

As discussed, the vertical movement of the rotational pivot allows for a wide variety of exercises to be carried out. Thus preferably the rotational pivot may be positioned a distance from less than 20 cm to greater than 100 cm above the ground, preferably from less than 15 cm to greater than 150 cm, more preferably from less than 15 cm to greater than 200 cm. The greater the range of movement of the rotational pivot, the wider the range of movements becomes possible.

For example, the rotational pivot can be slideably mounted in the frame, e.g. mounted on vertical rails, so as to enable vertical movement. Adjustment may be effected in a variety of ways such as e.g. with a pin-and-hole locking and adjustment mechanism. However a wide variety of alternative means of adjustment may be possible, allowing for a gradual or discrete vertical adjustment. One preferred alternative is to mount the rotational pivot on a pivot mount arm, the pivot mount arm itself being rotatably mounted on the frame, such that as the pivot mount arm rotates relative to the frame, the rotational pivot moves in an arc, and therefore provides the vertical movement, albeit also with horizontal movement.

The apparatus operates by the horizontal reaction arm having a rest position, where there is no net resistive force applied to the horizontal reaction arm. This therefore represents the starting point for a movement of the horizontal reaction arm by a human user at the start of a training movement. In order to provide for a wider variety of exercise movements, the rest position of the horizontal reaction arm may be adjusted to a position where it is below, at an angle to and/or above the rotational pivot. This adjustment of the rest position may be carried out in a wide variety of ways, e.g. by providing for a box section attached to the rotational pivot to be adjusted by a pin-and-hole arrangement.

Preferably the horizontal reaction arm comprises a cushioned pad. The pad may be rotationally symmetrical so that as the horizontal reaction arm rotates, the pad provides a convenient pushing surface for the human user. Alternatively the pad may not be radially symmetrical and the cushioned pad may then be rotatably mounted on the reaction arm, so that as the reaction arm moves, the pad's orientation with respect to the frame remains constant.

Accordingly, when the horizontal reaction arm comprises a cushioned pad, the element of the horizontal reaction arm to which the actuation arm is rotationally mounted is the cushioned pad, as this is the contact point with the human user. The horizontal reaction arm absent the cushioned pad may be rigidly attached to the actuation arm, in which case the cushioned pad will then also rotate relative to the horizontal reaction arm, and thus relative to the actuation arm. Alternatively, the horizontal reaction arm absent the cushioned pad may be rotationally mounted on the actuation arm, and the cushioned pad can then either be rigidly attached to the horizontal reaction arm or rotationally attached.

The apparatus may be provided with a plurality of replacement cushioned pads, such that the pad may be removed and replaced with one more suitable for a specific resistance training movement.

Additionally, the horizontal reaction arm may be adapted to receive a removable shaped attachment, to facilitate pushing or pulling of a specific subset of resistance training movements.

In an embodiment the frame of the apparatus supports a seat to support the body of the human user during an exercise movement. Preferably the seat is moveably adjustable both horizontally and vertically relative to the frame, as this provides maximum flexibility in terms of use. Such a seat may be removeable or stowable within the frame, when not in use. The seat can be adjusted to be in a position to support a number of parts of the human user, so it can be sat on, knelt on, lay on, leant on, etc.

The seat may comprise interchangeable or moveable pads and/or extension arms, such that the seat may be adapted to be more suitable for a specific resistance training movement, or to support different body parts of the human user.

It is desirable that the apparatus is arranged such that it has a clear exercise space for the human user. This allows a greater variety of exercises to be carried out. Thus, the apparatus is arranged such that it can be notionally divided into two halves by a vertical planar divider that passes through the apparatus, and which is perpendicular to the horizontal reaction arm, defining an exercise half comprising the horizontal reaction arm and the actuation arm, and a mechanical half comprising the frame and resistance means. If a seat is present it may also be present in the exercise half, but if so it is preferably also stowable into the mechanical half, keeping it out of the exercise half when not needed.

Optionally, the apparatus may comprise a locking means e.g. a toggle pin, operative to prevent movement of the horizontal reaction arm. The reaction arm may then be used to push against while static, to provide a still further range of resistance movements achievable.

Additional features may be provided to provide an even greater range of exercises. For example, bands may be provided, e.g. attached to the floor of the apparatus or to the frame.

Due to the number of degrees of freedom of adjustment of the apparatus, a large number of resistance training exercises can be carried out, including but not limited by the following:

Gluteal Muscles
1. Glute Bridge
2. Hip Thrust
3. Single-leg Hip Extension
4. Glute Kickback (behind knee)
5. Glute Donkey Kickback (from foot)
6. Bent Leg double-leg Kickbacks (using seat with extension)
7. Thigh Push Downs
8. Back Extension Abductor
1. Standing Thigh abductor
2. Quadruped Fire Hydrant Adductor
1. Standing Thigh adductor
2. Quadruped thigh adductor Hamstrings
1. Lying Leg Curl
2. Standing Leg Curl
3. Reverse Hyper Extension (with specialised seat extension)
4. High Kick (hip flexion)
5. Nordic Hamstring Curl Quadriceps
1. Sissy Squat
2. Seated Leg Extension
3. Pendulum Press
4. Single Leg Press
5. Step Ups (using seat as the platform)
6. Kneeling Squat
7. Lateral Step Up (using seat as platform)
8. Reverse Lunge Chest
1. Floor Press (not optimal due to arc but still effective)
2. Incline Press (improved with specialised curved bar Pad alternative)
3. Leverage Decline Press (improved with specialised curved bar Pad alternative)
4. Bent Over Single Arm FLY
5. Single Arm FLY
6. Incline Push Up (using seat)
7. Decline Push Up (using seat)

Back/Shoulders
1. Bent Over Row (improved with specialised curved bar Pad alternative)
2. Seated Shoulder Press
3. Single-arm Reverse FLY
4. Kneeling Delt Raise
5. Seated Row 6. Single-arm Incline Lateral Raise (if able to set seat at a 30-45 deg tilt)
7. Seated Good-morning Biceps and Triceps 1. Bicep Curl Standing Unsupported
2. Kneeling Preacher Curl (using seat at 30-45 deg angle for forearms)
3. Triceps Pushdown
4. Reverse grip Bicep Curl The invention will now be illustrated, by way of example, and with reference to the following figures, in which.

Figure 1:
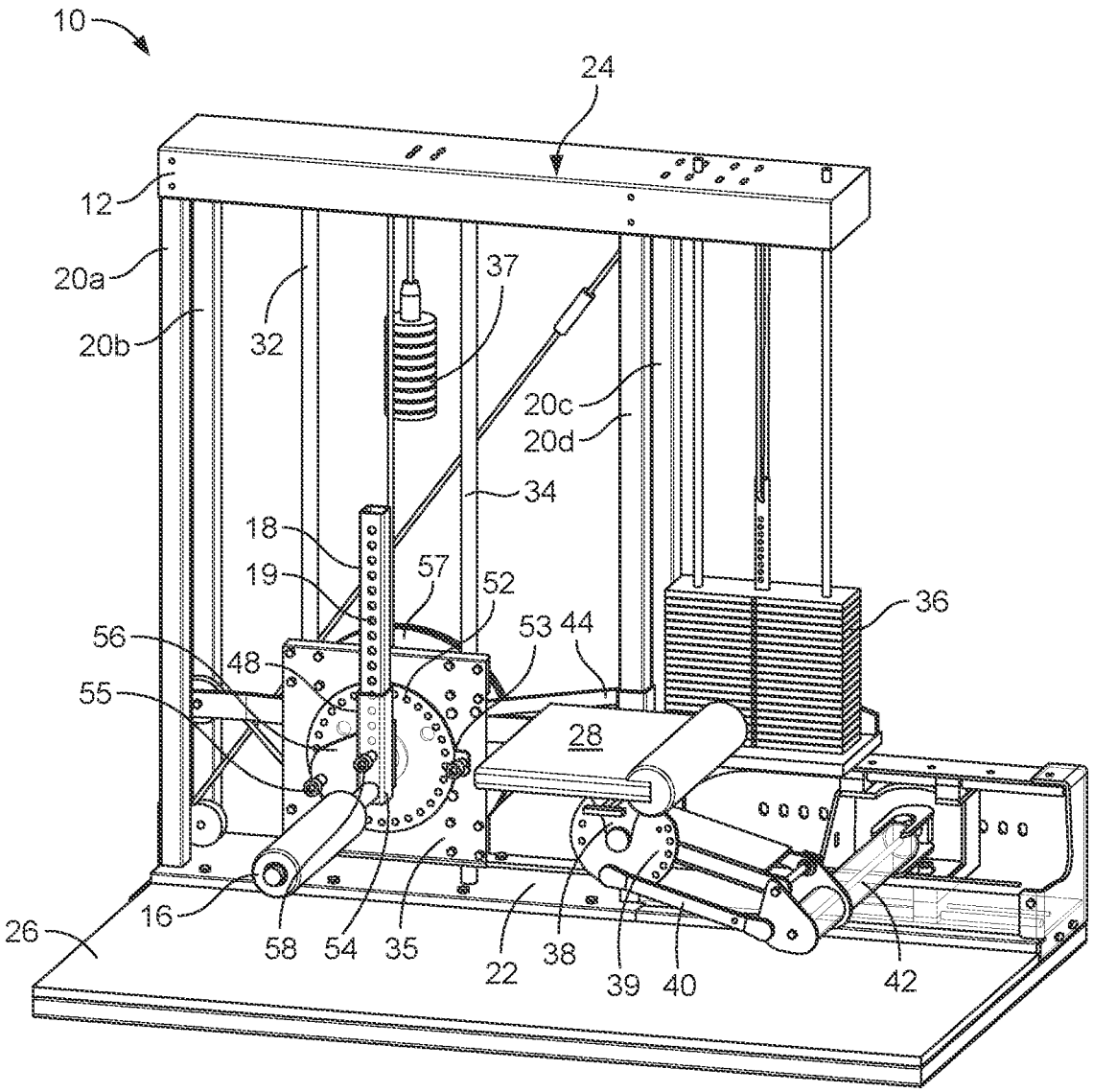
FIG. 1 is a perspective view of the front face of an apparatus according to the present invention in a first operating position.
Figure 2:
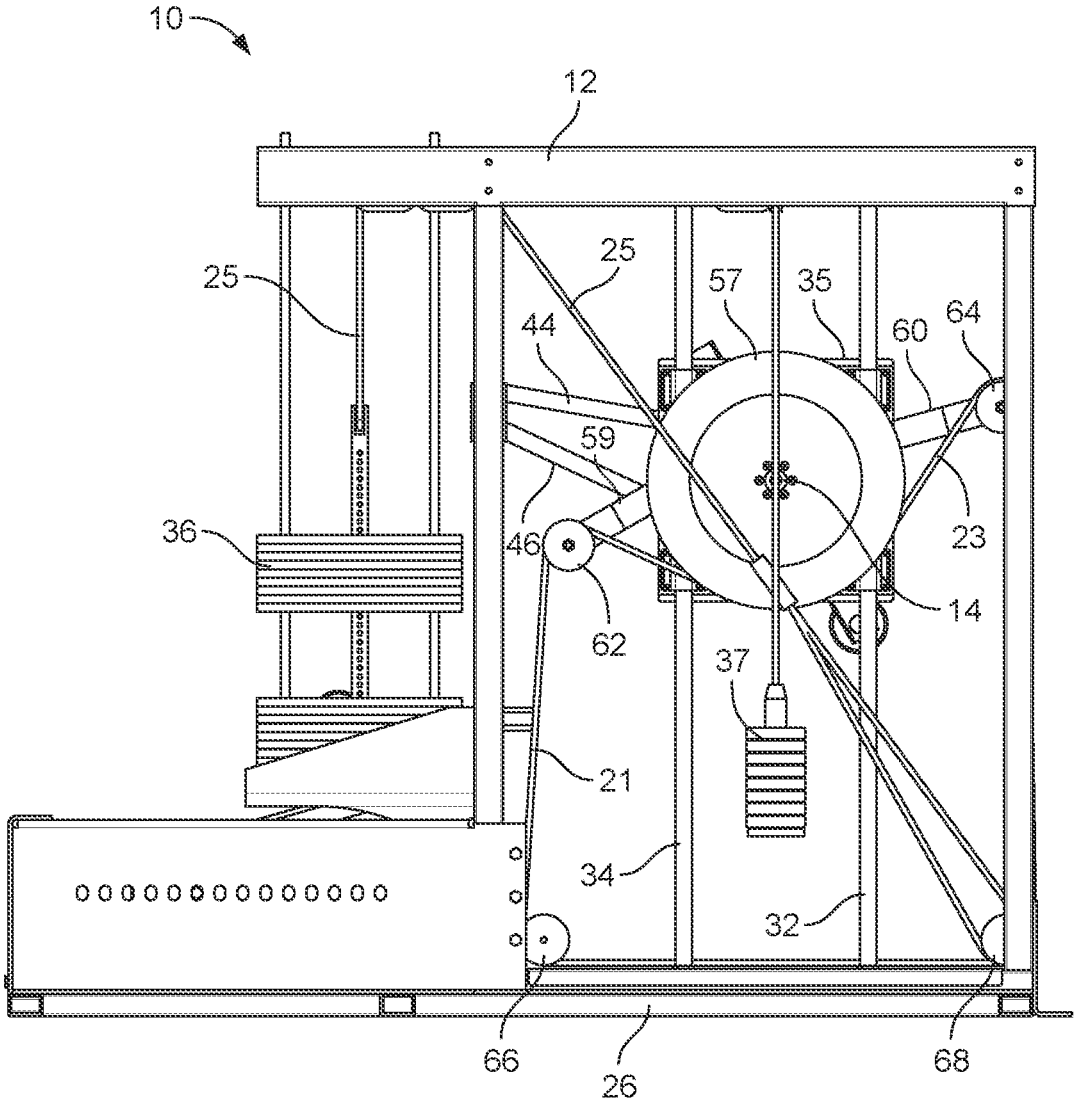
FIG. 2 is a rear view of the apparatus shown in FIG. 1, with the rotational pivot moved vertically upwards and in a second operating position.
Figure 3:
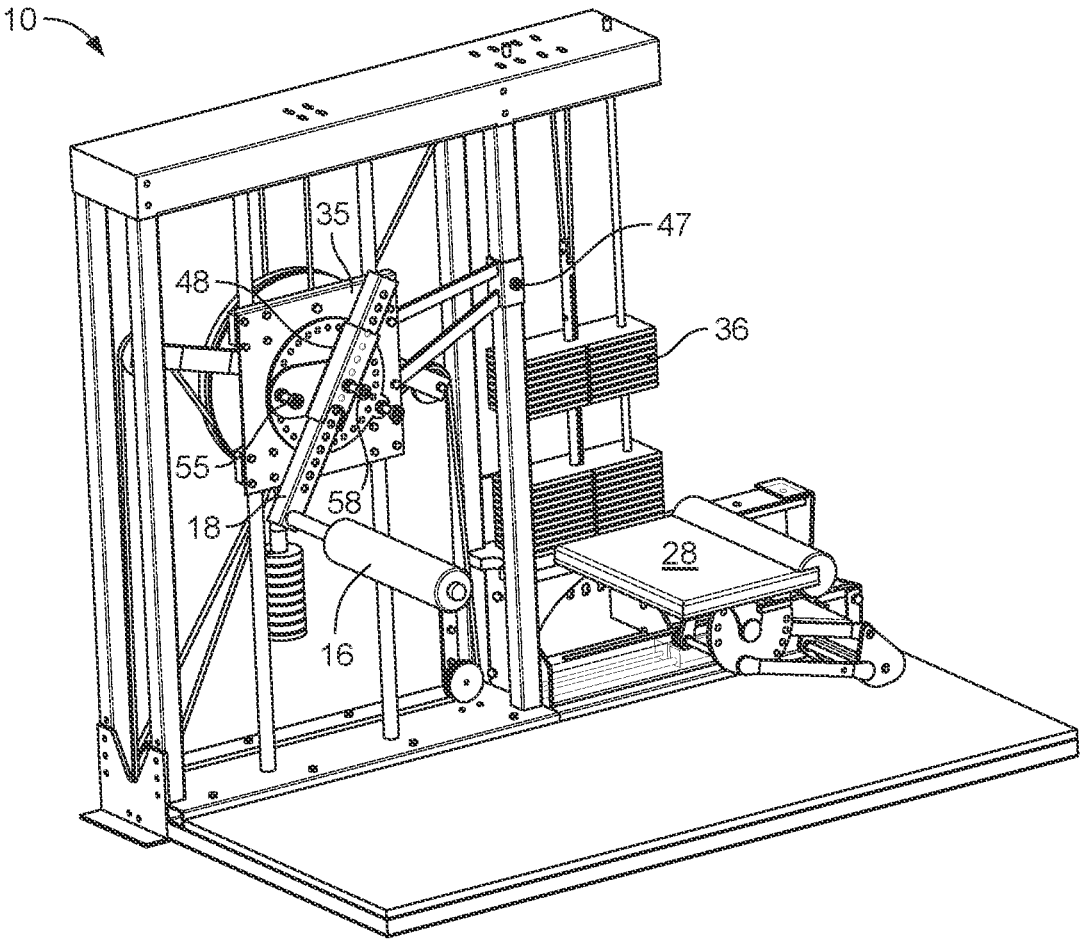
FIG. 3 is a perspective view of the front face of the apparatus shown in FIG. 2.

Turning to the figures, FIGS. 1 to 3 show an apparatus 10 for resistance training for use by a human user comprising a frame 12 supporting a rotational pivot 14, a horizontal reaction arm 16 and an actuation arm 18.

The frame 12 comprises vertical structural supports 20*a*, 20*b*, 20*c*, 20*d* connecting a frame base 22 to a frame top 24. Attached to frame base 22 is a floor 26. The frame also comprises two vertical rails 32, 34 and a weight stack 36.

Also provided is a seat 28 connected to frame 12 comprising a seat mount 38 which is rotatably connected to a pair of supporting discs 39, which are, in turn, connected via parallel struts 40 to swing arm 42, which is connected to the frame 12.

Slideably mounted on the vertical rails 32, 34 is a square plate 35, the centre of which supports the rotational pivot 14 and which is clamped to vertical structural support 20*d* via struts 44, 46 and screw clamp 47. To counteract the gravitational force on the square plate 35, it is connected to a counter-weight 37.

Looking at the apparatus 10 from the front, rotatably mounted on the rotational pivot 14 is a rotatable plate 48 comprising a series of circumferentially spaced holes 52. The rotatable position of the rotatable plate can be fixed by use of toggle pin 53. Also rotatably mounted on rotational pivot 14 is a box section 54 having rigidly attached thereto a flange 56. The position of the box section 54 relative to the rotatable plate 48 is governed by the position of pin 58 which is adapted to enter one of spaced holes 52. The actuation arm 18 can pass through box section 54 and is held in place relative thereto by use of pin 58 placed in one of the holes 19 in actuation arm 18.

Looking at the apparatus 10 from the rear, also mounted on rotational pivot 14 is a resistance wheel 57 that comprises two arms 59, 60 that end in pulley wheels 62, 64 beneath which an additional pair of pulley wheels 66, 68 is also provided. Cables 21, 23, 25 are provided connecting the weight stack 36 to the resistance wheel 57 via pulley wheels 62, 64, 66, 68.

Cable 21 is connected to the outer rim of resistance wheel 57, passes over pulley wheel 62, around pulley wheel 66 and pulley wheel 68 to connect with cable 25. Cable 23 is also connected to the outer rim of resistance wheel 57, passes over pulley wheel 64, around pulley wheel 68 to connect with cable 25.

In use, a human user (not shown) may be seated on seat 28 with the apparatus in the position as shown in FIG. 1. In this initial position, the actuation arm 18 is fully inserted into box section 54, so that the shortest possible distance is provided between the horizontal reaction arm 16 and the rotational pivot 14, which in this case is about 7 cm. Additionally, the square plate 35 is in its lowest position, so that the rotational pivot 14 is also in its lowest position, which in this case is about 20 cm from the floor 26. Additionally, the flange 56 is attached to rotatable plate 48 via pin 55 entering a hole 52 so that the box section is vertically aligned. Thus, in this rest position the horizontal reaction arm 16 is vertically below the rotational pivot 14.

From this initial position the human user may carry out e.g. a leg extension by pushing on the horizontal reaction arm 16. This causes the rotatable plate 48 and the resistance wheel 57 to rotate clockwise (when viewed from the front as shown in FIG. 1), pulling on cables 21, 25 and lifting weight stack 36. Any slack created in cable 23 is managed by the rising upwards of pulley 64 by the rotation of resistance wheel 57. The lifting of the stack 36 results in tension in the cables 21, 25 which is felt as resistance to rotation of the horizontal reaction arm 16 by the legs of the human user. If the resistance wheel 57 had been rotated anti-clockwise, this would pull on cables 23, 25 and lift weight stack 36 in like manner.

When it is desired to carry out a different resistance exercise, the apparatus 10 can be adjusted, e.g. to the position shown in FIGS. 2 and 3.

As can be seen, square plate 35 is now in a raised position relative to the frame 12 so that the rotational pivot 14 is also in a raised position, which in this case is about 120 cm from the floor 26. This has been achieved by loosening screw clamp 47 and sliding the square plate 35 vertically along rails 32, 34.

Additionally, the actuation arm 18 has been moved relative to the box section 54, so that a greater distance is provided between the horizontal reaction arm 16 and the rotational pivot 14. This has been achieved by pulling on pin 58, sliding the actuation arm 18 relative to the box section and reinserting pin 58 into a new hole 19.

Additionally, the rest position of the horizontal reaction arm 16 has been moved relative to the rotational pivot 14, so that at rest it is at an angle thereto and no longer vertically below the pivot 14. This has been achieved by pulling on pin 58 and rotating the flange 56 relative to rotatable plate 48 and reinserting pin 58 into a hole 52 once in place.

Thus, the apparatus 10 is now ready for a completely different resistance training exercise, which may be carried out from a standing position, such as a glute kickback.

Additionally, if it is desired to carry out an resistance training exercise where no movement of the reaction arm 16 is required, toggle pin 53 can be inserted so as to prevent any rotation of the rotatable plate 48 and thus also the reaction arm 16.

To accompany the wide variety of exercise positions possible by the apparatus, the seat 28 is also adjustable. The height of the seat 28 may be adjusted by movement of parallel struts 40 having the effect of raising or lowering supporting discs 39. The angle of the seat 28 relative to the floor 26 may also be adjusted by the orientation of the connection between the seat mount 38 which is rotatably connected to a pair of supporting discs 39.

For certain exercises the seat 28 will not be needed, e.g. during a standing exercise. In order to create more space on the floor 26 for the exercise, the seat 28 may be folded away into the frame 12, by the action of swing arm 42.

It can also be seen that the apparatus 10 can be notionally divided into two halves by a vertical planar divider that passes through the apparatus 10, and which is perpendicular to the horizontal reaction arm 16, defining an exercise half comprising the horizontal reaction arm 16 and the actuation arm 18, and a mechanical half comprising the frame 12 and weight stack 36. Thus, the frame and weight stack are out of the way of the 'front' of the apparatus 10 keeping the exercise half free for the user to perform a wide range of movements without physical hindrance. Additionally, although the seat 28 is in the exercise half, it can be stowed into the frame 12 in the mechanical half.

Figure 4:
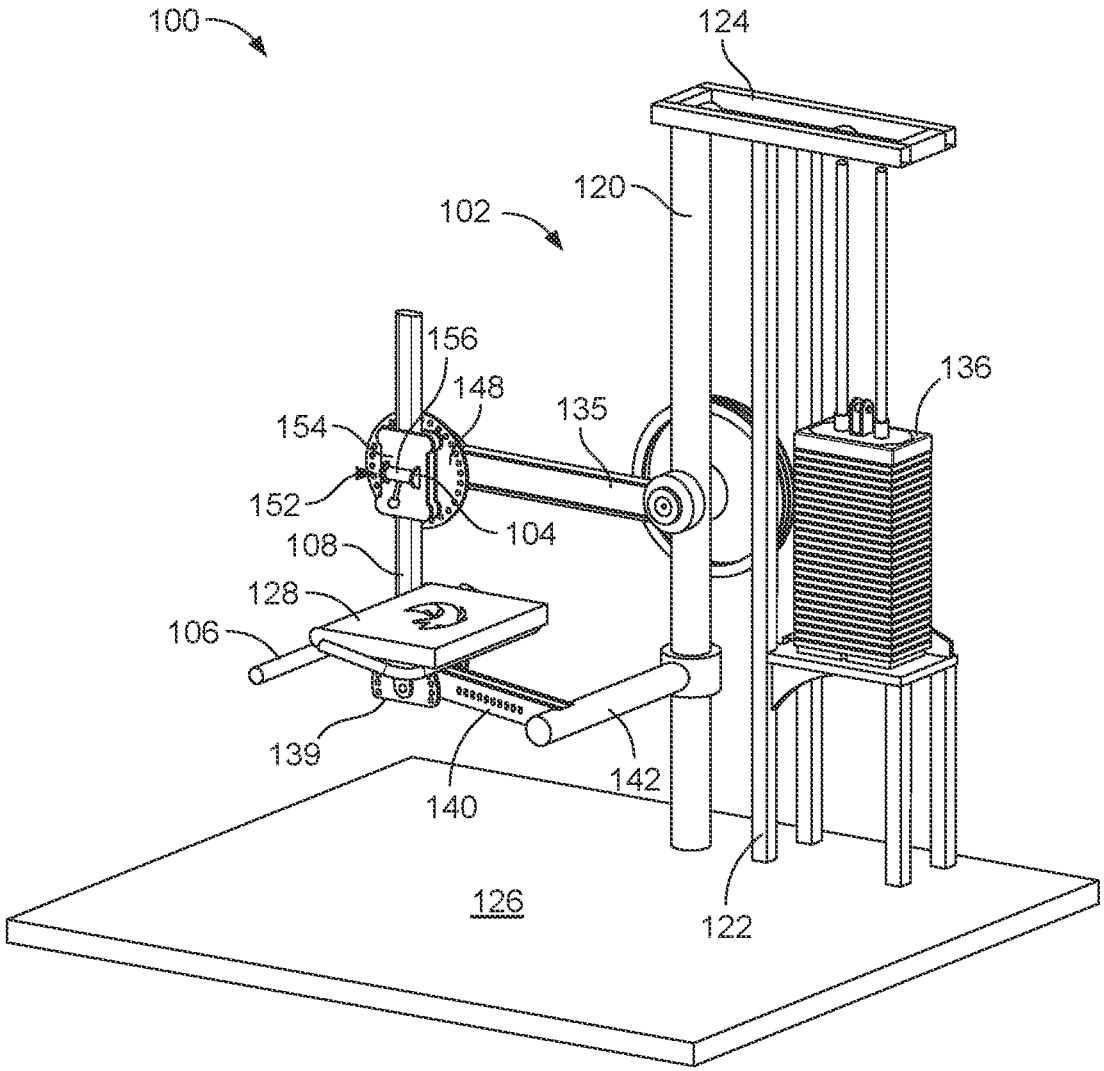
FIG. 4 is a perspective view of a second apparatus according to the present invention.

FIG. 4 shows a second apparatus 100 for resistance training for use by a human user comprising a frame 102 supporting a rotational pivot 104, a horizontal reaction arm 106 and an actuation arm 108.

The frame 102 comprises a vertical structural support 120 connecting a frame base 122 to a frame top 124. Attached to frame base 122 is a floor 126. The frame also comprises a weight stack 136.

Also provided is a seat 128 connected to frame 102 and which is rotatably connected to a pair of supporting discs 139, which are, in turn, connected via strut 140 to swing arm 142, which is connected to the vertical structural support 120.

Rotationally mounted on the vertical structural support 120 is a pivot mount arm 135, which supports the rotational pivot 104 and which is rotationally attached to vertical structural support 120.

Looking at the apparatus 100 from the front, rotatably mounted on the rotational pivot 104 is a rotatable plate 148 comprising a series of circumferentially spaced holes 152. Also rotatably mounted on rotational pivot 104 is a box section 154. The actuation arm 108 can pass through box section 154 and is held in place relative thereto by use of a clamp 156.

In use, a human user (not shown) may be seated on seat 128. In this initial position, the pivot mount arm 135 is horizontal and fixed in place, so that the rotational pivot 104 is in a mid position, which in this case is about 70 cm from the floor 126. Additionally, the actuation arm 108 is fixed at right angles to the pivot mount arm 135. Thus, in this rest position the horizontal reaction arm 116 is vertically below the rotational pivot 104.

From this initial position the human user may carry out e.g. a leg extension by pushing on the horizontal reaction arm 106. This causes the rotatable plate 148 to rotate clockwise (when viewed from the front as shown in FIG. 4), pulling on cables (not shown) and lifting weight stack 136. The lifting of the stack 136 is felt as resistance to rotation of the horizontal reaction arm 106 by the legs of the human user.

When it is desired to carry out a different resistance exercise, the apparatus 100 can be adjusted, e.g. by altering the rotational position of the pivot mount arm 135 to increase or decrease the vertical height of the rotational pivot 104.

It can also be seen that the apparatus 100 can be notionally divided into two halves by a vertical planar divider that passes through the apparatus 100, and which is perpendicular to the horizontal reaction arm 106, defining an exercise half comprising the horizontal reaction arm 106 and the actuation arm 108, and a mechanical half comprising the frame 102 and weight stack 136. Thus, the frame and weight stack are out of the way of the 'front' of the apparatus 100 keeping the exercise half free for the user to perform a wide range of movements without physical hindrance. Additionally, although the seat 128 is in the exercise half, it can be stowed into the mechanical half by rotation about the swing arm 142.

The invention claimed is:

1. An apparatus for resistance training for use by a human user, the apparatus comprising a frame supporting:

a rotational pivot for providing rotation in a vertical plane; and a horizontal reaction arm adapted to be moved by a body part of the human user; and an actuation arm, the actuation arm being rotatably mounted on the rotational pivot and rotationally mounted on the horizontal reaction arm;

such that application of force on the horizontal reaction arm causes the reaction arm to move about the rotational pivot whilst remaining horizontal; the frame further comprising a resistance means arranged to apply a user-selected resistive force that must be overcome to induce movement of the horizontal reaction arm from a rest position, wherein the actuation arm has a length that is adjustable by the human user, wherein the rotational pivot is vertically moveable within the frame, and wherein the horizontal reaction arm is capable of being moved in both a clockwise or anti-clockwise sense about the rotational pivot;

wherein the frame supports a seat to support the body of the human user; and wherein the seat is moveably adjustable both horizontally and vertically relative to the frame.

2. The apparatus according to claim 1, wherein movement of the horizontal reaction arm causes it to move about the rotational pivot in a circular manner.

3. The apparatus according to claim 1, wherein the movement in each direction about the rotational pivot has the same resistive force response.

4. The apparatus according to claim 1, wherein the radius of curvature of the movement of the horizontal reaction arm is adjustable from less than 20 cm to greater than 30 cm.

5. The apparatus according to claim 1, wherein the actuation arm is arranged to slideably engage with the rotational pivot, preferably through a sleeve such as a box section, wherein the sleeve is rotatably connected to the rotational pivot.

6. The apparatus according to claim 1, wherein the rotational pivot is mounted on a pivot mount arm, the pivot mount arm itself being rotatably mounted on the frame, such that as the pivot mount arm rotates relative to the frame, the rotational pivot moves in an arc, and therefore provides the vertical movement, albeit also with horizontal movement.

7. The apparatus according to claim 1, wherein the rotational pivot may be positioned a distance from less than 20 cm to greater than 100 cm above the ground.

8. The apparatus according to claim 1, wherein the rest position of the horizontal reaction arm may be adjusted to a position where it is below, at an angle to and/or above the rotational pivot.

9. The apparatus according to claim 1, wherein the horizontal reaction arm comprises a cushioned pad, and further wherein the actuation arm is rotationally mounted on the cushioned pad.

10. The apparatus according to claim 8, wherein a plurality of replacement cushioned pads are provided, such that the pad may be removed and replaced with a more suitable pad for a specific resistance training movement.

11. The apparatus according to claim 1, wherein the seat is removeable or stowable within the frame when not in use.

12. The apparatus according to claim 1, which can be notionally divided into two halves by a vertical planar divider that passes through the apparatus, and which is perpendicular to the horizontal reaction arm, defining an exercise half comprising the horizontal reaction arm and the actuation arm, and a mechanical half comprising the frame and the resistance means.

13. The apparatus according to claim 12, wherein the seat is stowable into the mechanical half.

14. The apparatus according to claim 1, which comprises a locking means operative to prevent movement of the horizontal reaction arm.

* * * * *